US005893806A

United States Patent [19]

Martinez

[11] Patent Number: 5,893,806

[45] Date of Patent: Apr. 13, 1999

[54] BATTING INSTRUCTION METHOD AND APPARATUS

[76] Inventor: Rodolfo Martinez, 3413 Linda Vista Ter., Los Angeles, Calif. 90032

[21] Appl. No.: 08/901,906

[22] Filed: Jul. 29, 1997

Related U.S. Application Data

[63] Continuation of application No. 08/322,061, Oct. 12, 1994, Pat. No. 5,662,536.

[51] Int. Cl.[6] ..... A63B 69/40

[52] U.S. Cl. ..... 473/447

[58] Field of Search ..... 473/451, 426, 473/420, 417, 327, 236; 40/200

[56] References Cited

U.S. PATENT DOCUMENTS

| | | | |
|---|---|---|---|
| D. 194,688 | 2/1963 | Santora | 473/327 |
| 310,248 | 1/1885 | Brown . | |
| 664,338 | 12/1900 | Sprague | 473/237 |
| 676,506 | 6/1901 | Knight | 473/327 |
| 716,541 | 12/1902 | Hillerich . | |
| 771,247 | 10/1904 | Hillerich . | |
| 1,108,441 | 8/1914 | Hubbell | 473/327 |
| 1,293,941 | 2/1919 | Sargent | 473/237 |
| 2,660,436 | 11/1953 | Grossman | 473/237 |
| 3,081,091 | 3/1963 | Grow | 473/237 |
| 3,139,282 | 6/1964 | Lande . | |
| 3,246,894 | 4/1966 | Salisbury . | |
| 3,325,168 | 6/1967 | Fyanes | 473/236 |
| 3,370,851 | 2/1968 | Murray | 473/327 |
| 3,425,693 | 2/1969 | Murray | 473/327 |
| 3,489,411 | 1/1970 | Morelli et al. | 473/437 |
| 3,618,945 | 11/1971 | Kuchar et al. . | |
| 3,753,565 | 8/1973 | Baker | 473/327 |
| 4,445,685 | 5/1984 | Cardieri . | |
| 4,456,250 | 6/1984 | Perrone, Jr. . | |
| 4,575,080 | 3/1986 | Miles . | |
| 4,664,374 | 5/1987 | Groves | 473/417 |
| 4,709,924 | 12/1987 | Wilson et al. . | |
| 4,796,885 | 1/1989 | Wright | 473/417 |
| 4,819,937 | 4/1989 | Gordon . | |
| 4,867,450 | 9/1989 | Katz . | |
| 4,962,924 | 10/1990 | James . | |
| 4,989,866 | 2/1991 | Dill . | |
| 4,991,838 | 2/1991 | Groves | 40/327 |
| 5,004,234 | 4/1991 | Hollis | 473/417 |
| 5,013,046 | 5/1991 | Koch | 473/327 |
| 5,067,719 | 11/1991 | Mook | 473/200 |
| 5,106,085 | 4/1992 | Lewy . | |
| 5,320,343 | 6/1994 | McKinney | 473/417 |
| 5,580,047 | 12/1996 | Shih | 473/417 |
| 5,662,530 | 9/1997 | Seller | 473/327 |

*Primary Examiner*—Theatrice Brown
*Attorney, Agent, or Firm*—Graham & James LLP

[57] ABSTRACT

A baseball instructional device and method for use teaches a hitter how to properly hit a ball depending on the location at which the ball is thrown by the pitcher. The device is capable of positioning a baseball, softball, or other ball, at proper hitting positions relative to the hitter, thus teaching the hitter when and where to swing to make proper contact with the ball. In addition to positioning the ball relative to the hitter, the device is provided with visual indicators to assist in teaching the hitter the proper location for striking the ball with the bat.

12 Claims, 2 Drawing Sheets

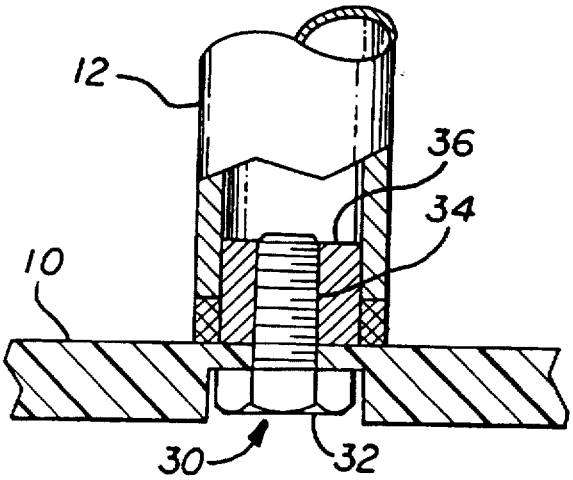
FIG. 3
FIG. 4
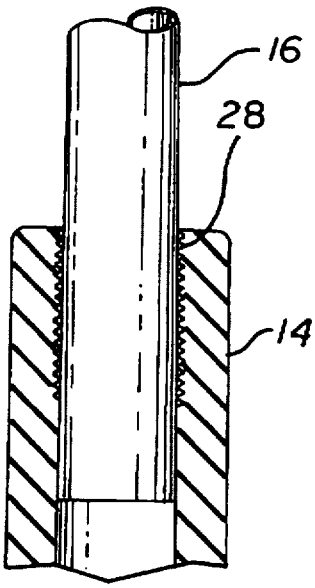
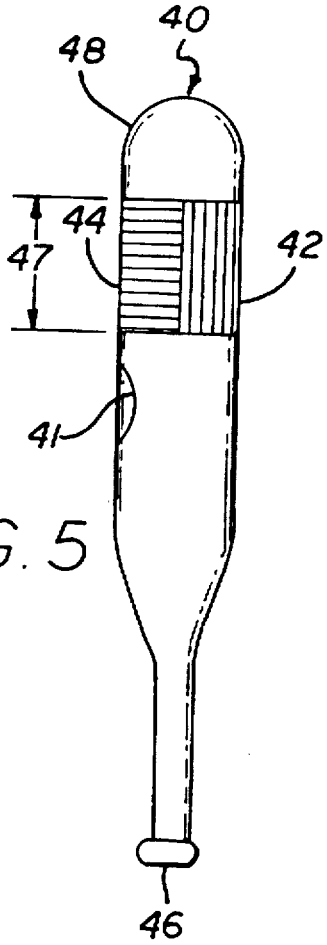
FIG. 5
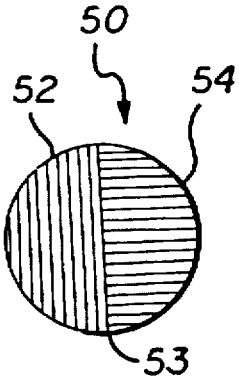
FIG. 6

BATTING INSTRUCTION METHOD AND APPARATUS

RELATED APPLICATION

This application is a continuation of application Ser. No. 08/322,061, filed Oct. 12, 1994 now U.S. Pat. No. 5,662,536.

BACKGROUND OF THE INVENTION

1. Field of the Invention

The present invention generally relates to training aids for use in sporting activities. More particularly, the present invention is directed to an improved method and apparatus for instructing a batter on the proper technique for hitting a baseball or softball with a bat.

2. Description of the Prior Art and Related Information

It has been said that many professional athletes in all different sports consider the art of hitting a baseball or softball correctly to be the single most difficult thing to do in any sport. In little league baseball, a batter has one to two seconds to identify a pitch, make a decision whether to swing at a pitch, and then complete a proper swing of the bat to make contact with the ball. In professional baseball, where it is not uncommon to have pitchers who can throw a baseball between 80 and 100 miles per hour, a batter has one-fifth of a second (0.2 seconds) to identify the pitch, decide whether to swing the bat, and to swing the bat so as to make contact with the ball!

In addition, given that the useful area of bat for making proper contact with the ball is approximately four to six inches long and about one and one-half inches wide (depending on the location of the pitch and size of the bat), one can readily understand the difficulty associated with becoming a successful batter. Perhaps this explains why, in professional baseball, players are considered good hitters if they are able to successfully hit a baseball as few as 25 to 30 times out of 100 attempts. It also helps explain why Ted Williams, who in one memorable season successfully hit the ball an average of more than 40 times per 100 attempts, is considered in mythic proportions. Very few believe his achievement will ever be duplicated.

Given the love for baseball in the United States, it is not to be unexpected to find prior art related to the devices for attempting to teach proper batting techniques. The most common prior art batting instruction aid in use today is a standard batting tee in which a tube, oftentimes adjustable in height, is attached to a piece or rubber or plastic in the shape of a home plate, and a ball is supported by the tube. Such a batting tee is used to simulate the ball, having been pitched by a pitcher, crossing the plate for the batter to swing at.

However, the standard batting tee described above, which is used in little leagues, grade schools, high schools, colleges, and by professional baseball and softball teams across the country, has a major flaw. That is, depending upon the location of the pitch which is thrown, it may be necessary for the batter to swing at and make contact with the ball either before the ball reaches the plate or after the ball has passed the plate and is approaching the glove of the catcher. By "location," it is meant that a ball may be thrown by the pitcher inside, outside, high or low. Such pitches may be thrown in or out of the strike zone, and the location of the pitch, i.e., inside, outside, etc., will, to a great extent, dictate the batter's swing.

For example, for an inside pitch, it is necessary for the hitter to begin swinging the bat and make contact with the ball when the ball is well in front of the plate. Similarly, for an outside pitch, in order to make proper contact with the ball, the batter must swing the bat and make contact with the ball as the ball is crossing the back threshold of the plate. This is commonly referred to a "going with the pitch."

However, prior art batting tees teach a batter to swing at a ball so as to contact the ball as it is crossing the center of the plate. As discussed above, this is not proper form, depending on the location of the pitch. Thus, prior art batting tees teach a batter what is essentially an incorrect method for the development of proper batting technique, particularly for younger players.

"Tee-ball" leagues for young children have sprung up all over the United States and in many foreign countries. This type of a league utilizes a batting tee instead of having a pitcher pitch the ball. In such a league, the children are very young and are developing the fundamental skills necessary to play the game. It is therefor essential that these children are taught proper batting technique. However, the use of a standard batting tee discussed above teaches such children to hit a baseball or softball as the ball is crossing the center of the plate. This is incorrect.

As an alternative, some coaches try to improve upon the prior art batting tee by using a batting tees placed in front of home plate. The ball is placed on the tee and the children are instructed to align themselves with the actual home plate behind the plate which is attached to the batting tee. While this technique is somewhat better than using only the batting tee itself, children often have difficulty transferring the lessons learned from this type of instruction method to an actual playing situation in which there is only the batting tee. In this situation, children can become confused, discouraged and disheartened with the game of baseball.

While it has often been said that practice makes perfect, if a player does not practice using the proper technique, the player will ultimately perfect what are essentially bad habits conducive to poor hitting performance. Once an individual has learned an improper technique for hitting a baseball or softball, it is extremely difficult for such an individual to rid themselves of the bad habits developed through the improper learning technique.

Accordingly, there is a need for a device which properly simulates a pitch thrown by a pitcher such that the batter can learn when to swing at a ball depending upon the location of the pitch and can also learn where to stand relative to the plate to achieve the best results. In addition, there is a need for a method and apparatus for teaching the proper fundamentals of batting such as alignment with home plate and the proper contact points between the bat and the ball to ensure the development of a good batting technique.

SUMMARY OF THE INVENTION

The present invention is directed to an improved batting instruction method and apparatus in which batters are taught proper batting technique for any location where a pitch may be thrown by a pitcher. In addition, batters are taught proper placement of themselves relative to the actual plate and when to swing at a ball depending upon the location of the pitch. With the present invention, an individual will learn proper batting technique and avoid the pitfalls associated with utilizing prior art devices.

The present invention obviates the problems associated with the prior art using a unique form of batting tee that allows the ball to be properly placed, relative to home plate, for hitting depending on the location of the pitch being simulated. Further, the present invention utilizes indicia for indicating proper contact between the bat and the ball. Using the present invention, a batter sets up relative to home plate and a ball can be positioned at an optimum hitting point relative to the plate. Thus, the batter learns proper stance relative to home plate as well as where to swing at the ball in order to make proper contact depending on the location of the pitch.

The present invention, which has been generally discussed above, will be more readily understood through the accompanying detailed description of the invention taken in conjunction with the figures of which the following is a brief description:

BRIEF DESCRIPTION OF THE FIGURES

FIG. 3 shows a detail of the connection between the plate and the ball support mechanism of FIG. 1;

FIG. 4 shows a detail of the fit between various portions of the ball supporting device of FIG. 1;

FIG. 5 shows a bat in accordance with the present invention for use with the device shown in FIG. 1;

FIG. 6 shows a ball for use in conjunction with the device of FIG. 1.

DETAILED DESCRIPTION OF THE PREFERRED EMBODIMENT

Figure 1:
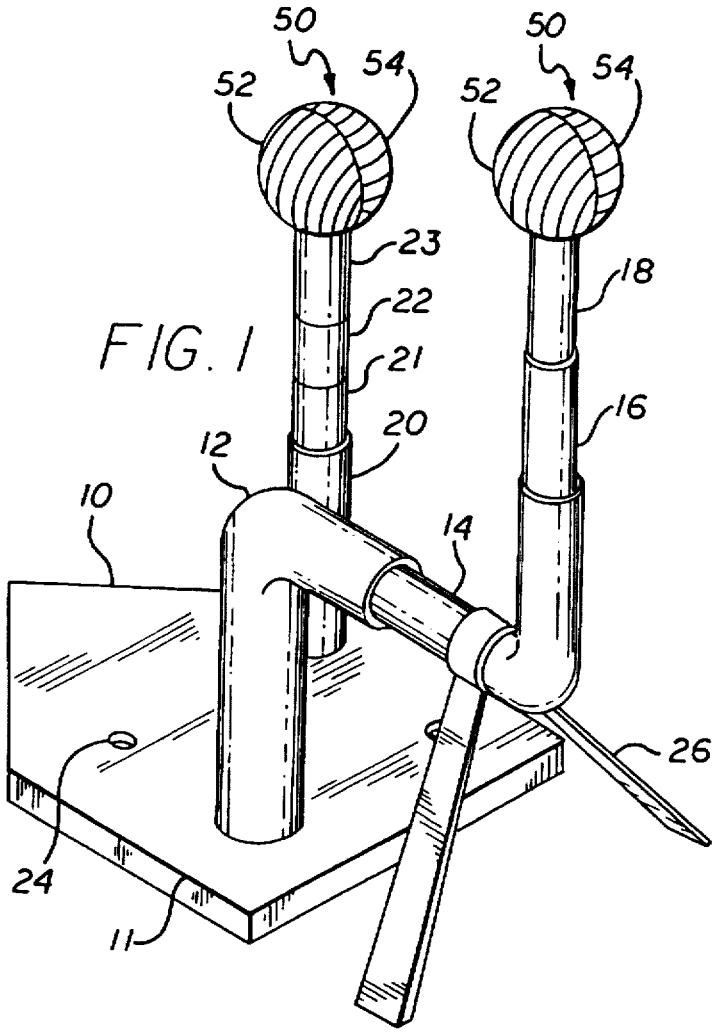
FIG. 1 shows a perspective view of the batting instruction device of the present invention.
Figure 2:
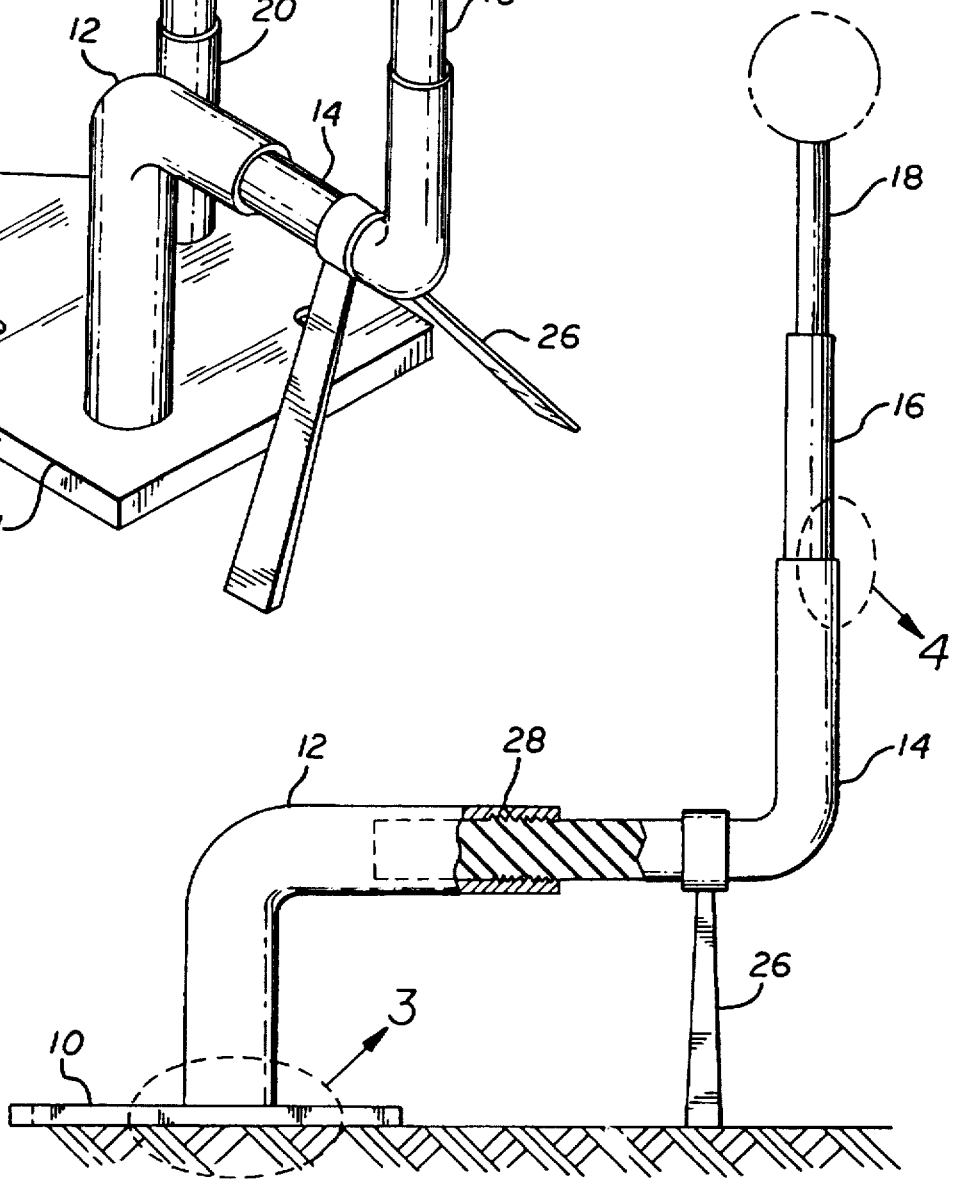
FIG. 2 shows a side elevational view of the batting instruction device of FIG. 1.

As can seen in FIGS. 1–4, the present invention includes a plate 10 having a first ball supporting device connected thereto. The home plate 10 is provided with a plurality of openings 24 formed therein so that the ball supporting devices can be attached to various positions about the plate.

The first ball supporting device includes a first vertical member 12. The first vertical member 12 extends upward therefrom and mates with a radial member 14. The radial member 14 mates with a second vertical member 16. A third vertical member 18, which supports a baseball 50 on one end thereof mates with the second vertical member 16. A support 26, which can be formed to fit about the circumference of the radial member 14, is provided to prevent excessive sagging of the radial member 14 due to the weight of vertical members 16 and 18.

A second ball supporting device can be connected to the home plate 10 at the same time as the first ball supporting device. The second support device is shown comprised of vertical members 20, 21, 22, and 23 which are similar in construction to the above discussed vertical and radial members. By making the second ball support device with four interconnecting members, a wide range of height adjustment can be provided to simulate multiple pitches at various points in the strike zone. An advantage to using two ball supporting devices together will become clear from the discussion below.

The vertical and radial members described above are preferably formed of a heavy duty rubber material, which can be easily molded using a simple molding process. Other suitable, stiff yet pliable materials could also be used with the present invention. Alternatively, it would be possible to make several of the components out of different materials, such as metal.

That is, while it is necessary to have the vertical member 18 (or possibly vertical member 16 depending the particular use to which the present invention is put) which supports the baseball be made of a flexible material so that when a batter swings the bat and hits the vertical member 18, it does not break, the vertical portion 12 and the radial portion 14 could conceivably be made of a less resilient material provided that it is rugged. For example, a heavy duty plastic could be appropriate. Support 26 can also be made of metal, rubber or plastic and can also be formed as a single extension extending down from the radial member 14 as opposed to the bi-pod structure shown in the drawings.

Members 12, 14, 16, and 18 can be formed of any appropriate size. Preferably, vertical member 12 extends 10" above the plate, 18" along the horizontal plane of the plate, and is 2.5" in diameter. Radial member 14 has a length of 18" along the horizontal and vertical portions and a diameter of approximately 2.25". Vertical member 16 has a length of 20" and a diameter of approximately 2". Vertical member 18 has a length of 20" and a diameter of 1.75". Vertical members 20, 21, 22, and 23 which make up a second ball support for use with the present invention, are preferably sized at 10" by 2.5", 20" by 2.25", 20" by 2", and 20" by 1.75", respectively.

In the preferred embodiment, vertical members 12, 16, and 18 and radial member 14 fit together utilizing a friction fit which is shown in more detail in FIG. 4. In particular, the fit between the various members may be a "telescoping" fit in which the individual members slide together in a coaxial fashion with friction holding the individual members at desired positions.

To assist in making a proper and secure friction fit, the outer coaxial member can be provided with grooves or ridges 28 formed therein. The plurality of grooves or ridges 28 surrounding the inserted member serve to provide sufficient friction to hold the inserted member in the desired position yet allow the relative positions of the connected members to be adjusted by twisting or otherwise pulling the inserted member with sufficient force to overcome the friction force created by the grooves or ridges 28.

Referring in particular to FIG. 3, the interconnection of the vertical member 12 and the plate 10 is illustrated. A bolt 30 having a head 32 and a threaded portion 34 is inserted through an opening 24 in the plate 10 and interconnects with a threaded coupling 36 disposed in the vertical member 12. Threaded coupling 36 is preferably made of metal to provide a secure connection. In addition, coupling 36 can extend up into the vertical member 12 any desired length to assist in providing structural rigidity to the ball support device. As shown, the coupling is disposed in the vertical member 12 which can comprise a heavy duty rubber which is molded about the coupling 36. Alternatively, the vertical member 12 can be made entirely of metal to provide additional structural integrity. The bolt is tightened and the vertical member 12 is held securely to the plate. The plate 10 can include molded detents on the underside of the plate 10 which are formed to fit around the head portion 32 of bolt 30. Thus, the bolt can be held in place while the vertical member 12 including the coupling 36 is twisted about the threaded portion 34 to secure the member 12 to the plate 10.

Due to the threaded interconnection of the coupling 36 and the threaded portion 34, the ball supporting member can be swiveled about the plate 10 to properly position the ball supporting device to simulate a desired pitch. In addition, the telescoping connections between members 12, 14, 16 and 18 allow an almost limitless variation of the ball position. The coupling 36 and the bolt 30 are preferably made of metal.

Alternative methods for connecting the ball supporting devices to the plate 10 are intended to fall within the scope of this invention. In particular, it is clear that the bolt 30 could be permanently attached to the vertical member 12 and extend through the top of plate 10 and protrude from the bottom thereof and be secured by way of a nut. Alternatively, the vertical member 12 could be provided with a keyed member protruding therefrom which is inserted into a preformed "key-hole" opening in the plate 10. After insertion, the vertical member 12 could be turned to securely hold the vertical member 12 to the plate 10.

Referring to FIGS. 5 and 6, the bat 40 is provided with distinct hit indicators 42 and 44. The ball 50 is provided with distinct strike indicators 52 and 54. In practice, hit indicator 42 corresponds to strike indicator 52 and hit indicator 44 corresponds to strike indicator 54. That will become more clear from the discussion below as to the use of the present invention.

The size of the hit indicators 42, 44 are determined by measuring from the end of the bat 48 farthest from the handle 46 approximately 10 inches down the length of the shaft of the bat. At the measured distance, a line is drawn about the circumference of the bat. A second measurement of approximately three inches is taken from the end 48 toward the handle 46. A second line is drawn about the circumference of the bat. The two lines define a cylindrically shaped portion 49 of the bat which is approximately seven inches long. Depending on the size of the bat, this portion may vary in size (larger or smaller).

The cylindrical portion 49 is then divided in half along the longitudinal axis thereof and only one half of the cylinder is utilized (either side). If a wooden bat is utilized, the division is taken, preferably, along a longitudinal axis which, if extended, would split the manufacturer's label 41 in half. The half cylinder portion is again divided in half along the longitudinal axis of the bat to produce the areas defining the hit indicators 42, 44. These areas are then marked to distinguish them from the rest of the bat. E.g., one section 42 could be painted blue, while the other 44 could be painted red.

The process of providing strike indicators 52, 54 for the ball 50 is somewhat less complicated. Simply put, the ball is divided into two equal halves 52, 54, which are then marked to correspond to the hit indicators 42, 44. Although corresponding markings are not absolutely necessary, it is helpful to avoid confusion. Thus, if hit indicator 42 is painted red, strike indicator 52 would be painted red as well. Similarly, if hit indicator 44 is painted blue, strike indicator 54 would be painted blue.

The operation of the present invention will now be described. Referring to FIG. 1, which is set up for left-handed batter, vertical member 23 supports a ball 50 to simulate an outside pitch. The ball supporting device including members 12, 14, 16 and 18 would simulate an inside pitch.

Prior to swinging, using the bat shown in FIG. 5, the batter would stand at the plate 10 (in a proper batting stance relative to plate 10) and hold the bat level over the plate such that the label 41 thereon is facing straight up (in the opposite direction from the plate) and the hit indicators 42, 44 are facing towards the forward portion of the plate 10. Further, balls 50 are positioned on the members 23, 18 such that the strike indicator 54 corresponding to the top hit indicator 44 (when bat 40 is held out over the plate) faces away from the batter and the centerline 53 of ball 50 is substantially parallel to the lateral side edge 11 of the plate 10.

At this point, the batter swings the bat 40 so as to make contact with ball 50 supported by member 18 and ball 50 supported by member 18.

However, when bat 40 contacts ball 50 supported by the member 18 to simulate an outside pitch, the batter needs to utilize that portion of the bat 40 identified as hit indicator 42. Furthermore, hit indicator 42 must meet the ball 50 along the strike portion 52. In this manner, the outside pitch will be hit to the opposite field, in this case to the left field.

As the batter continues swinging the bat 40, proper hand rotation will cause that portion of the bat 40 identified as hit indicator 44 to contact ball 50 supported by vertical member 18. Hit indicator 44 should make contact with strike indicator 54 on the ball 50. In this manner, the ball 50 will be pulled to the right field which is proper for an inside pitch.

As evident from a review of FIG. 1, ball 50 supported by vertical member 18, which simulates an outside pitch, is properly struck when the ball 50 has passed the majority of the plate 10. conversely, ball 50 supported by vertical member 18 and simulating an inside pitch, must be struck before the ball reaches the plate 10 in order to be hit properly.

By controlling the swing of the bat 40 to ensure that hit indicator 42 contacts the ball 50 on member 18 on the strike indicator 52 and hit indicator 44 contacts ball 50 on member 18 on the strike indicator 54, the batter will ensure proper swing technique and wrist release. By repeatedly practicing this motion, the batter will develop proper batting technique.

The above discussion illustrates that a proper batting technique will result in the same swing to make contact with an outside pitch as with an inside pitch. Given the speed at which the ball 50 is often travelling in actual game situations, this technique teaches the batter that he or she must anticipate an outside pitch in order to correctly hit an inside pitch. Since the present invention is able to simulate both inside and outside pitches at the same time, a batter can train to hit the outside ball to the opposite field, and following through, pull the inside pitch down the line to the proper field (for the left-handed batter set up of FIG. 1 this would be the right field).

Finally, the present invention provides instant feedback as to whether a batter is making proper contact with ball 50. A coach can monitor the performance of a player and determine whether the player is making proper contact between the bat 40 and the ball 50 depending upon which portion of the bat 40 contacts the ball 50.

Using the above-described method and apparatus for teaching batting technique, a batter will develop the proper fundamental skills on how to properly hit a baseball. Further, an individual will not only learn proper batting technique, but also proper placement of his or her body relative to the plate 10 shown in FIG. 1. There is no need to use multiple batting tees to teach proper position relative to the plate as with the prior art or to move the ball supporting device and plate to properly position a ball since the present invention accurately positions the ball depending upon the location of the pitch being simulated. Accordingly, the present invention overcomes the problems associated with prior art batting tees and teaches individuals of all ages proper batting techniques.

I claim:

1. A batting instruction method comprising the steps of:

providing a plate;

providing a ball support means movably connected to said plate for supporting a ball at a stationary position removed from said plate;

adjusting said stationary position of said ball relative to said plate to simulate a pitch from a pitcher of said ball; and providing said ball with a plurality of visible indicators thereon, said plurality of visible indicators defining a plurality of contact points on said ball for said stationary positioning of said ball relative to a batter adjacent to said plate, whereby said contact points enable said batter to practice striking said ball to simulate either an inside or outside pitch.

2. A method according to claim 1, wherein said adjusting step comprises the step of positioning said ball at a location relative to said plate at which said ball should be struck by a batter in accordance with a type of pitch being simulated.

3. A batting instruction method comprising the steps of:

providing a plate;

providing a ball support means movably connected to said plate for supporting a ball at a stationary position removed from said plate;

adjusting said stationary position of said ball relative to said plate to simulate a pitch from a pitcher of said ball; and providing said ball with a plurality of visible indicators thereon, said plurality of visible indicators defining contact points of said ball for said stationary positioning of said ball relative to a batter adjacent to said plate; and providing a bat for hitting said ball, said bat also having a plurality of visible indicators thereon for indicating where said bat should contact said ball by correspondence with said plurality of visible indicators of said ball.

4. A method according to claim 3, further comprising the steps of:

providing a correspondence between said plurality of strike indicators and said plurality of hit indicators such that at least one of said plurality of strike indicators corresponds to a particular one of said plurality of hit indicators, instructing a batter to stand adjacent said plate and swing said bat so as to make contact with said ball, and determining if proper contact is made between said bat and said ball by observing whether said particular hit indicator on said bat contacts said at least one strike indicator on said ball, thereby indicating if said batter has swung said bat correctly.

5. A batting instruction method comprising the steps of:

providing a plate;

providing a first ball support means movably connected to said plate for supporting a first ball at a stationary position removed from said plate;

providing a second ball support means movably connected to said plate for supporting a second ball at a stationary position removed from said plate;

adjusting said stationary position of said first ball and said second ball relative to a batter and said plate to simulate two types of pitches from a pitcher of said first ball and said second ball;

wherein said stationary positions of said first ball and said second ball allow a batter to swing and hit said first ball and then follow through and hit said second ball in one continuous swing;

providing said first ball and said second ball with respective visible indicators thereon, said visible indicators defining a plurality of contact points on said first ball and said second ball for said stationary positioning of said first ball and said second ball relative to a batter and said plate, whereby said contact points enable said batter to practice striking said ball to simulate either an inside or outside pitch.

6. A method according to claim 5, further comprising the step of providing a bat for hitting said first ball and said second ball.

7. A method according to claim 6, wherein said adjusting step comprises the step of adjusting said stationary positioning of said first ball at a location relative to said plate at which said first ball should be struck by a batter in accordance with one type of pitch being simulated, and adjusting said stationary positioning of said second ball at another location relative to said plate at which said second ball should be struck by a batter in accordance with another type of pitch being simulated;

wherein said stationary positioning of said first ball and said second ball is selected to enable the batter to hit at least one of said first ball and said second ball in one continuous swing of said bat.

8. A batting instruction method comprising the steps of:

providing a plate;

providing a first ball support means movably connected to said plate for supporting a first ball at a stationary position removed from said plate;

providing a second ball support means movably connected to said plate for supporting a second ball at a stationary position removed from said plate;

adjusting said stationary position of said first ball and said second ball relative to a batter and said plate to simulate two types of pitches from a pitcher of said first ball and said second ball;

wherein said stationary positions of said first ball and said second ball allow a batter to swing and hit said first ball and then follow through and hit said second ball in one continuous swing;

providing said first ball and said second ball with respective visible indicators thereon, said visible indicators defining contact points of said first ball and said second ball for said stationary positioning of said first ball and said second ball relative to a batter and said plate;

providing a bat for hitting said first ball and said second ball;

wherein said adjusting step comprises the step of adjusting said stationary positioning of said first ball at a location relative to said plate at which said first ball should be struck by a batter in accordance with one type of pitch being simulated, and adjusting said stationary positioning of said second ball at another location relative to said plate at which said second ball should be struck by a batter in accordance with another type of pitch being simulated;

wherein said stationary positioning of said first ball and said second ball is selected to enable the batter to hit at least one of said first ball and said second ball in one continuous swing of said bat; and wherein said step of providing said first ball and said second ball further comprises providing a plurality of strike indicators on said first ball and said second ball for indicating a plurality of striking locations on said first ball and said second ball, and said step of providing a bat further comprises providing a plurality of proper hitting positions at which said bat should contact said first ball and said second ball in accordance with the type of pitches being simulated.

9. A method according to claim 8, further comprising the steps of:

providing a correspondence between said plurality of strike indicators on said first ball and said plurality of hit indicators on said bat such that at least one of said plurality of strike indicators on said first ball corresponds to a particular one of said plurality of hit indicators on said bat, providing a correspondence between said plurality of strike indicators on said second ball and said plurality of hit indicators on said bat such that at least one of said plurality of strike indicators on said second ball corresponds to a particular one of said plurality of hit indicators on said bat, instructing a batter to stand adjacent said plate and swing said bat so as to make contact with said first ball and with said second ball, and determining if proper contact is made between said bat and said first ball and said second ball by observing whether said particular hit indicators on said bat contacts a corresponding one of said at least one strike indicators on said first ball and said second ball, respectively, thereby indicating if said batter has swung said bat correctly.

10. A batting training apparatus comprising:

a plate;

a ball having a plurality of strike indicators thereon;

a bat having a plurality of hit indicators thereon, said plurality of strike indicators of said ball corresponding respectively to said hit indicators of said bat; and ball support means movably connected to said plate for supporting said ball at a stationary position removed from said plate, said stationary position of said ball being selected to simulate a pitch from a pitcher of said ball;

wherein contact between said bat and said ball should occur at corresponding ones of said strike and hit indicators to achieve proper relative position of a batter to said plate.

11. The batting training apparatus of claim 10, wherein said ball support means comprises:

a first vertical member connected to said plate and extending upward from a plane of said plate a predetermined distance, a radial member connected to said first vertical member and extending radially outward therefrom, and a second vertical member connected at a first end thereof to said radial member and extending upward therefrom, said second vertical member supporting said ball at a second end thereof.

12. The batting training apparatus of claim 10, further comprising:

second ball support means disposed at a location on said plate and extending vertically upward therefrom for supporting another ball at a position above said location on said plate.

* * * * *